United States Patent [19]

Orenstein

[11] 4,209,938

[45] Jul. 1, 1980

[54] APPENDAGE OPERATED TOYS

[75] Inventor: Henry Orenstein, Verona, N.J.

[73] Assignee: Toy Builders, Union, N.J.

[21] Appl. No.: 867,219

[22] Filed: Jan. 6, 1978

[51] Int. Cl.[2] ..... A63H 13/00

[52] U.S. Cl. ..... 46/116; 46/139; 40/411

[58] Field of Search ..... 46/116, 118, 119, 150, 46/123, 139; 40/411, 418, 419, 420

[56] References Cited

U.S. PATENT DOCUMENTS

| | | | |
|---|---|---|---|
| 934,025 | 9/1909 | Steiff | 46/119 |
| 3,553,885 | 1/1971 | Tazaki | 46/116 |
| 4,027,424 | 6/1977 | Kilroy et al. | 46/116 |

*Primary Examiner*—Russell R. Kinsey
*Assistant Examiner*—Mickey Yu
*Attorney, Agent, or Firm*—George E. Kersey

[57] ABSTRACT

Appendage operated toys in which a moveable appendage of a toy figure energizes a power train that extends through the figure for engagement with an accessory that is operable by the power train. The power train may be used to store energy by virtue of the movement of the appendage, with the energy being released by operation of another appendage.

10 Claims, 3 Drawing Figures

APPENDAGE OPERATED TOYS

BACKGROUND OF THE INVENTION

This invention relates to toys, and, more particularly, to toys in which the motive power for operation is provided without the need for batteries.

It is common for modern toys to be self-propelled. Originally such toys generally had springs which were would by a key to store the necessary motive energy. The need for such a key has detracted from the appeal and appearance of toys. Modern self-propelled toys have generally avoided the need for windup keys by using batteries. Unfortunately, popular toys can place such a drain on batteries that they have a comparatively short life. In addition the costs of batteries have increased significantly.

Accordingly, it is an object of the invention to simulate the effect of battery operated toys without the need for batteries. A related object is to eliminate the need for batteries while providing the same appeal and appearance as battery operated toys. A further object of the invention is to enhance the versatility of a non-battery operated toy.

Another object of the invention is to achieve the activation of toys, and accessories without the need for external wind-up keys and their attendant detractions and disadvantages.

Still another object is to reduce the energy requirements for particular modes of toy operation.

SUMMARY OF THE INVENTION

In accomplishing the foregoing and related objects the invention provides a toy figure with a moveable appendage, such as a spring loaded arm, that is used to store energy, for example by winding a spring.

In accordance with one aspect of the invention, the stored energy is released when desired by moving another appendage, for example an ear which extends to an offset lever by which the energy storage device can be controlled.

In accordance with another aspect of the invention, the stored energy, when released, is applied at an extremity of the figure and is used to power selected accessories, for example a reciprocating figure that is operated by a pivoted lever with a light-weight strip cam that is energized by the control figure.

DESCRIPTION OF THE DRAWINGS

Other aspects of the invention will become apparent after considering several illustrative embodiments, taken in conjunction with the drawings in which.

DETAILED DESCRIPTION

Figure 1:
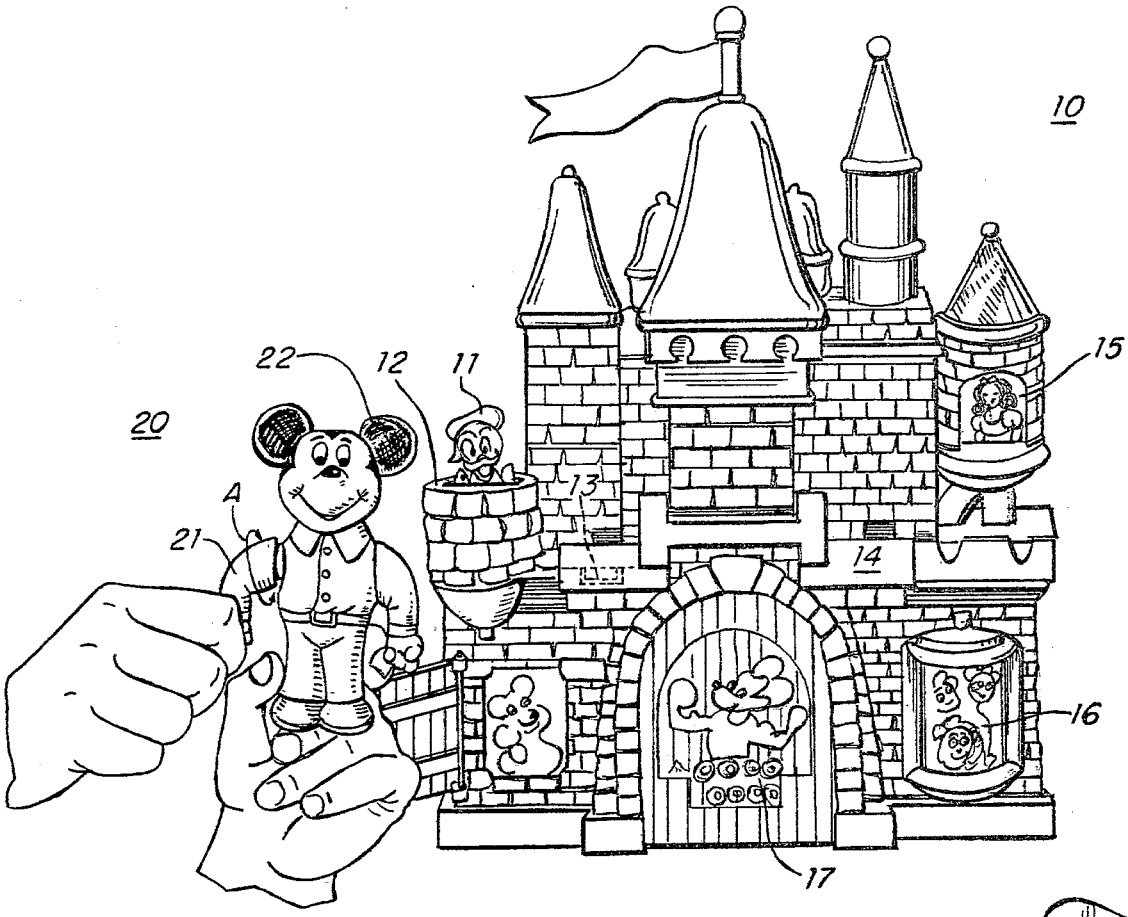
FIG. 1 is a perspective view of a toy activated accessory and an activating toy figure being energized in accordance with the invention.

Turning to the drawings, an accessory 10 which is operated by a control toy 20 in accordance with the invention is shown in FIG. 1. The figures are used by permission of the copyright proprietor, Walt Disney Productions.

As indicated, the user energizes the control toy 20 by winding an appendage such as an arm 21 in the direction indicated by the arrow A. The toy 20 is then inserted into the accessory 10, which is in the form of a castle with activatable parts.

In particular, the castle 10 includes a figure 11 which can move up and down in a parapet 12 when the control toy 20 is inserted into a socket 13. The energy stored in the toy 20 is then released to operate a power train by pushing the ear 22, as explained below in connection with FIGS. 2 and 3.

Other similar sockets (not shown) can be provided on the castle 10, such as at the position 14 for operating other parts, such as rotating the turret 15, rotating the window 16 and operating the door 17.

Figure 2:
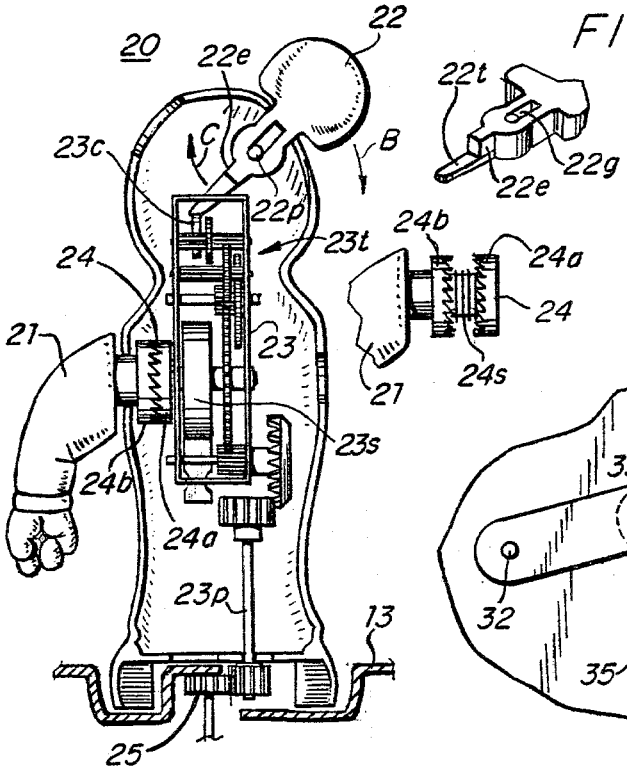
FIG. 2 is a partial sectional view of the toy figure of FIG. 1 showing its control constituents.

Considering the detailed mechanism of the control toy 20 as shown in FIG. 2, the arm is coupled to an energy storage mechanism 23 through a clutch 24, that is loaded with a spring **24*s* as shown in the inset fragmentary drawing. When the arm 21 is pushed against the spring 24*s*, compressing it, the teeth of the part 24*a* can mesh with the teeth of part 24*b*, as indicated in the main drawing of FIG. 2. This allows the spring 23*s* to be wound on its shaft, which is held stationary by the gear train 23*t*, as blocked by the engagement of a stop member 23*c* by the control lever extension 22*e* of the ear 22**.

When the ear 22 is moved in the direction B about a pivot **22*p*, the tip 22*t*, as shown in the inset drawing, is freed from contact with the stop member 23*c*, and energy from the spring 23*s* is transmitted to the power train 23*p* to the base extremity of the figure 20**.

Consequently, when the figure 20 is inserted into the socket 13 (FIG. 2) it is able to engage a suitable gear, such as the gear 25 and operate an accessory that is coupled to the gear 25.

It will be appreciated that the gear 25 is for illustration only and that the power train **23*p* may be used to engage any suitable kind of gear, such as that used to drive the power train from the storage mechanism 23**.

The lever extension **22*e* of the ear 22 is able to control the start and stop operation of the mechanism 23 with a comparatively low level of force by virtue of the fact that the gear train 23*t* causes the stop member 23*c* to rotate at a relatively high speed. This occurs because a succession of large gears drive smaller gears with respect to the drive shaft of the spring 23*s*. As a result, a low torque movement of the tip 22*t* into the path of the rapidly rotating stop 23*c* is able to jam the power train 23*t*** and prevent further rotation of the spring shaft.

In order to achieve the desired start and stop control using the ear appendage 22, the latter extends to the offset control tip **22*t* through an extension 22*e* which is mounted on the pivot 22*p* of an elongated guide channel 22*g***.

Figure 3:
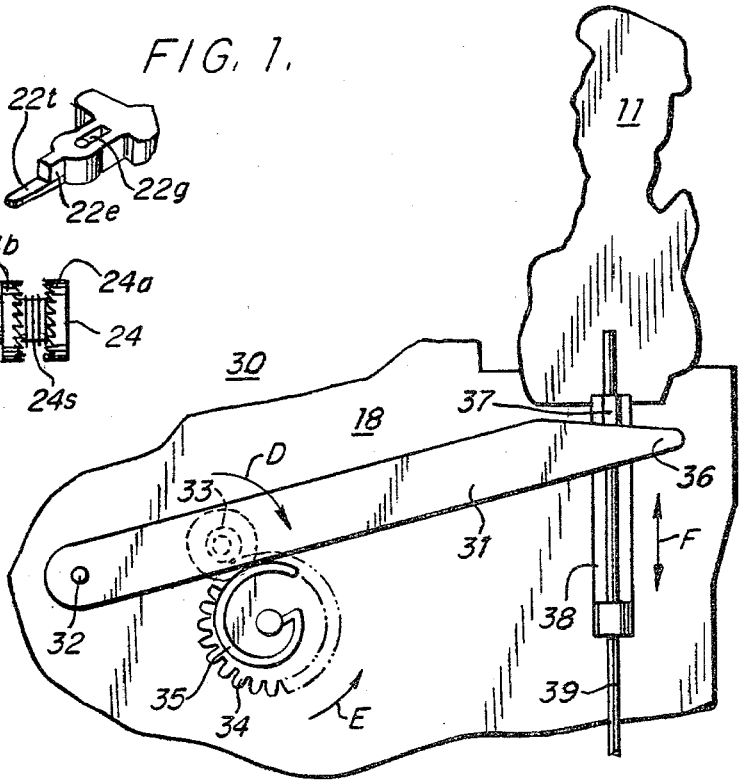
FIG. 3 is a fragmentary view of the accessory of FIG. 1 which is operable by a toy figure in accordance with the invention.

An illustrative operation of an accessory, such as the movement of the figure 11 in the parapet 12 of FIG. 1, is illustrated in FIG. 3.

The mechanism 30 for reciprocating the figure 11 is formed by a lever 31 pivoted to the wall 18 of the castle 10 at a pivot 32. The power train symbolized at 33 produces motion in a representative direction D and operates a spur gear 34 in a direction E, causing an attached strip cam 35 to act on the lever 31 and move the tip 36 in a reciprocating direction indicated by the double headed arrow F. Since the tip 36 is in contact with a projection 37 of a member 38 that slides on a fixed bar 39, this produces the desired reciprocation of the figure 11.

It will be appreciated that the transmission of power from the appendage wind-up and controlled figure 20 to the accessory, such as the mechanism 30 for the figure 11, can take place in a wide variety of ways, using, for example, a wide variety of different gear assemblages. It will also be understood that the wind-up and control appendages can also take a wide variety of forms including such things as articles of clothing of the wind-up and conrol figures.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A toy comprising a figure having a moveable appendage and an accessory activated by the figure;

means with said figure responsive to the movement of said appendage for storing energy therein;

means responsive to the energy storing means for applying energy at an extremity of said figure;

said accessory being powered by a gear train which engages the energy applying means at an extremity of said figure; and said accessory being a reciprocable figure operated by a lever which is in turn operated by a strip that forms a cam element powered by said gear train.

2. A toy as defined in claim 1 wherein said appendage comprises a spring-loaded lim of said figure.

3. A toy as defined in claim 2 further including means for controlling the release of said energy.

4. A toy as defined in claim 3 wherein the controlling means is a further appendage of said figure.

5. A toy as defined in claim 4 wherein said further appendage comprises a moveable ear of said figure.

6. A toy as defined in claim 1 wherein said energy storing means comprises a spring which is windable by movement of said appendage.

7. A toy as defined in claim 1 wherein said figure is used to activate an accessory.

8. A toy comprising a figure having a moveable appendage;

means within said figure responsive to the movement of said appendage for storing energy therein;

means responsive to the energy storing means for applying energy at an extremity of said figure; and means for controlling of said energy comprising a further appendage of said figure extending to an offset lever which engages the energy storing means.

9. A toy as defined in claim 8 wherein said appendage comprises a spring loaded limb of said figure.

10. A toy as defined in claim 8 wherein said further appendage comprises a moveable ear of said figure.

* * * * *